United States Patent [19]

Wiese et al.

[11] 4,088,453

[45] May 9, 1978

[54] PRODUCTION OF SOLID FUEL-WATER SLURRIES

[75] Inventors: Harry C. Wiese, San Diego; Jerrold R. Denchfield, Diamond Beach, both of Calif.; John C. Ahlborn, deceased, late of Pomona, Calif., by Lloyd Keys Ahlborn, executor, Hollywood, Calif.

[73] Assignee: Texaco Inc., New York, N.Y.

[21] Appl. No.: 699,407

[22] Filed: Jun. 24, 1976

[51] Int. Cl.[2] ..... C10L 1/32

[52] U.S. Cl. ..... 44/51

[58] Field of Search ..... 44/51, 6; 137/13

[56] References Cited

U.S. PATENT DOCUMENTS

| | | | |
|---|---|---|---|
| 2,346,151 | 4/1944 | Burk et al. | 44/51 |
| 2,648,950 | 8/1953 | Miller | 60/39.82 |
| 3,124,086 | 3/1964 | Sage et al. | 44/51 |

FOREIGN PATENT DOCUMENTS

| | | | |
|---|---|---|---|
| 406,067 | 2/1934 | United Kingdom | 44/51 |

*Primary Examiner*—Daniel E. Wyman
*Assistant Examiner*—Mrs. Y. Harris-Smith
*Attorney, Agent, or Firm*—Thomas H. Whaley; Carl G. Ries; Robert Knox, Jr.

[57] ABSTRACT

The pumpability of a solid fuel-water slurry is improved by the presence of a small amount of ammonia in the slurry.

10 Claims, No Drawings

PRODUCTION OF SOLID FUEL-WATER SLURRIES

This invention relates to the production of slurries of solid fuels in water. More particularly it is concerned with the production of slurries of finely ground solid fuel in water in which the slurries have a high solids content but still are pumpable.

Most solid fuels, as mined, contain varying amounts of water which in some instances may range up to 40 wt. % or even higher in the case of low grade solid fuels. This water is an undesirable constituent of the fuel, particularly in the case of fuels of high water content. If the mined solid fuel is to be transported to its place of end use by rail this means the transportation of a large amount of non-combustible material which has no fuel value. If the solid fuel is to be transported by pipeline in the form of a slurry here again water trapped in the pores of the solid fuel which form no part in the formation of the slurry must again be transported. Thus a slurry containing 50 wt. % water and 50 wt. % solid fuel would contain considerably less than that amount of fuel when the fuel is measured on a dry basis.

The amount of water necessary to form a pumpable slurry depends on the surface characteristics of the solid fuel. For example, soot formed during the partial oxidation of a carbonaceous material has such a high surface area that a concentration of such soot in water in excess of a few wt. % renders the resulting slurry unpumpable. In the case of a slurry which is to be fed to a gas generator, it is necessary that the solid fuel be ground to such an extent that a major portion thereof will pass through a 200 mesh sieve so that the particles are substantially completely converted to oxides of carbon during their short residence time within the gasification zone. However, ordinarily before reaching the gasification zone the slurry must pass through various pieces of equipment such as heat exchangers and compressors on its way from the slurry zone to the gas generation zone. Accordingly the slurry must be pumpable but in the case of a slurry made up of solid fuel particles most of which will pass through a 200 mesh sieve it has been found that ordinarily, a pumpable slurry must contain about from 55 to 60 wt. % water. Unfortunately a slurry containing this amount of water renders the operation of the gasifier unsatisfactory as this excessive amount of water moderates the temperature of the reaction zone to such an extent that it seriously affects its thermal efficiency. It has been found that the optimum amount of water in a solid fuel-water slurry which may be used as feed to a gas generation zone will lie from between 40 and 50 wt. %.

It is therefore an object of this invention to produce solid fuel water slurries having a relatively high solids content. Still another object of the invention is to produce pumpable slurries of solid fuel in water wherein the bulk of the solid fuel will pass through a 200 mesh sieve and in which the water content of the slurry will range between about 40 and 50 wt. %. These and other objects will be obvious to those skilled in the art from the following disclosure.

According to our invention there is provided a process for improving the pumpability of a solid fuel-water slurry which comprises adding to said slurry, $NH_4OH$, in an amount between about 0.1 and 5.0 wt. % based on the total weight of the slurry.

Any solid fuel such as anthracite, bituminous coal, sub-bituminous coal, coke and lignite may be used in the process of this invention although it is more particularly adapted to the treatment of the lower grade fuels such as sub-bituminous coal and lignite. The solid fuel should be in finely-divided form so that at least 50 wt. % and preferably at least 80 wt. % passes through a 200 mesh sieve (U.S. standard).

The ammonia may be added as a gas in which case it will dissolve in the slurry water or it may be added as ammonium hydroxide solution preferably in concentrated form as 28% $NH_3$ or 58% $NH_4OH$. In the following examples, the water added to the slurry with the $NH_3$ is used to calculate the total weight of the slurry. In some instances, solid fuel has also been added to the slurry to keep the percentage of solids constant for true comparison purposes.

The following examples are submitted for illustrative purposes and it should not be construed that the invention is restricted thereto. Although in the examples the ammonia is added after formation of the slurry, it will be appreciated that it is the presence of the ammonia in the slurry that results in the viscosity being lower than in the absence of ammonia. It is therefore within the contemplation of the invention that the slurry may be made with ammoniated water or that the ammonia may be added to the water simultaneously with the solid fuel.

EXAMPLE I

The coal used in this example was a dried Kentucky coal having the following sieve analysis:

TABLE 1

| Sieve # | Wt. % |
|---|---|
| 40 | 0.08 |
| 60 | 0.08 |
| 80 | 0.12 |
| 100 | 0.28 |
| 150 | 1.92 |
| 200 | 3.56 |
| 230 | 7.28 |
| 325 | 22.20 |
| −325 | 64.48 |

A slurry containing 51.9 wt. % dry coal in water was formed and various materials were added to portions of the slurry to determine the effect of the additive on the viscosity of the slurry. Viscosities were measured on a Stormer viscosimeter and are reported in centipoises. Data are tubulated below:

TABLE 2

| Additive | Wt. % Total Slurry | Viscosity |
|---|---|---|
| none | | 214 |
| $NH_4OH$ | 1.93 | 140 |
| $NH_4OH$ | 0.97 | 155 |
| KOH | 1.93 | 214 |
| $HNO_3$ | 2.33 | 204 |
| $(NH_4)_2S$ | 1.83 | 220 |
| $NH_4NO_3$ | 2.00 | 178 |
| $(NH_4)_2CO_3$ | 2.00 | 234 |
| $NH_4OH$ | 0.23 | 205 |

These data show that ammonium hydroxide in an amount between about 1 and 2 wt. % was the only additive having an appreciable effect on the viscosity of this slurry.

EXAMPLE II

In this example the same coal used in Example I was formed into a slurry with water. The coal content of the slurry was 49.1 wt. % measured on a dry basis. The viscosity of the slurry was 144 cps but with the addition of $NH_4OH$ in an amount to form 0.23 wt. % based on the total slurry weight the viscosity was reduced to 114.

In the following examples Ruhr coal and Kentucky bituminous coal were used. Their sieve analyses are as follows:

TABLE 3

| U.S. Standard Sieve | SIEVE ANALYSIS Ruhr Coal Wt. % Retained | Kentucky Bituminous Wt. % Retained |
|---|---|---|
| 40 | 0.12 | 0.0 |
| 60 | 0.12 | 0.0 |
| 100 | 0.36 | 0.16 |
| 150 | 1.92 | 3.32 |
| 200 | 8.00 | 10.00 |
| 230 | 7.32 | 11.12 |
| 325 | 22.48 | 40.36 |
| 400 | 28.48 | 15.56 |
| −400 | 31.2 | 19.48 |

EXAMPLE III

The following data shows how the presence of small amounts of $NH_4OH$ in the slurry results in a considerable reduction of the viscosity (Stromer) of a slurry prepared from the Ruhr coal having the sieve analysis reported above.

TABLE 4

| Wt. % dry solids | Viscosity | Wt. % $NH_4OH$ |
|---|---|---|
| 45.5 | 352 | — |
| 45.6 | 313 | 0.2 |
| 44.0 | 274 | — |
| 43.6 | 196 | 0.2 |

TABLE 4

| Wt. % dry solids | Viscosity | Wt. % $NH_4OH$ |
|---|---|---|
| 45.5 | 352 | — |
| 45.6 | 313 | 0.2 |
| 44.0 | 274 | — |
| 43.6 | 196 | 0.2 |

EXAMPLE IV

The solid fuel used in this example is the Kentucky Bituminous having the sieve analysis reported above. The data below show how $NH_4OH$ is much more effective than KOH in reducing the viscosity of a 52.8 wt. % slurry of the coal.

TABLE 5

| Wt. % dry solids | Viscosity | Additive |
|---|---|---|
| 52.8 | 498 | — |
| 52.8 | 478 | 0.2 wt. % KOH |
| 52.8 | 431 | 0.2 wt. % $NH_4OH$ |

From the above it is apparent that ammonia or ammonium hydroxide effectively reduces the viscosity of a solid fuel-water slurry and that, by means of the invention described herein, it is possible for a given solids content, to reduce the viscosity of a slurry or conversely, for a given viscosity, the solids content of the slurry can be increased.

Various modifications of the invention as hereinbefore set forth may be made without departing from the spirit and scope thereof, and therefore, only such limitations should be made as are indicated in the appended claims.

We claim:

1. A process for producing a solid fuel-water slurry of improved pumpability which comprises forming a solid fuel-water slurry also containing $NH_4OH$ in an amount between about 0.1 to 5.0 wt. % based on the total weight of the slurry.

2. The process of claim 1 in which the solid fuel is lignite.

3. The process of claim 1 in which the solid fuel is bituminous coal.

4. The process of claim 1 in which the solid fuel is sub-bituminous coal.

5. The process of claim 1 in which the solid fuel is anthracite.

6. The process of claim 1 in which at least 50% of the solid fuel passes through a 200 mesh sieve.

7. The process of claim 6 in which at least 80% of the solid fuel passes through a 200 mesh sieve.

8. The process of claim 1 in which the $NH_4OH$ is added in an amount between 0.2 and 3.0 wt. %.

9. The process of claim 6 in which the slurry contains between about 50 and 60 wt. % solid fuel measured on a dry basis.

10. The process of claim 1 in which the $NH_4OH$ is formed by contacting the slurry water with gaseous $NH_3$.

* * * * *